US009393587B2

(12) United States Patent
Ohno et al.

(10) Patent No.: US 9,393,587 B2
(45) Date of Patent: Jul. 19, 2016

(54) METHOD OF AND APPARATUS FOR FORMING A COATING LAYER ON A GOLF BALL

(71) Applicant: NIKE, Inc., Beaverton, OR (US)

(72) Inventors: Takahisa Ohno, Fujisawa (JP); Jun Ichinose, Kodaira Tokyo (JP)

(73) Assignee: Nike, Inc., Beaverton, OR (US)

( * ) Notice: Subject to any disclaimer, the term of this patent is extended or adjusted under 35 U.S.C. 154(b) by 176 days.

(21) Appl. No.: 14/227,376

(22) Filed: Mar. 27, 2014

(65) Prior Publication Data

US 2015/0273281 A1 Oct. 1, 2015

(51) Int. Cl.

| | |
|---|---|
| ***B05D 1/00*** | (2006.01) |
| ***A63B 45/00*** | (2006.01) |
| ***B05B 3/02*** | (2006.01) |
| ***B05D 1/02*** | (2006.01) |
| *B05B 13/02* | (2006.01) |

(52) U.S. Cl.

CPC ..... *B05D 1/002* (2013.01); *A63B 45/00* (2013.01); *B05B 3/02* (2013.01); *B05B 13/0235* (2013.01); *B05D 1/02* (2013.01); *B05B 13/0228* (2013.01)

(58) Field of Classification Search

None

See application file for complete search history.

(56) References Cited

U.S. PATENT DOCUMENTS

| | | | | |
|---|---|---|---|---|
| 2,079,615 | A | 5/1937 | Holt et al. | |
| 2,194,132 | A * | 3/1940 | Voit | A63B 41/00 156/147 |
| 2012/0283043 | A1 | 11/2012 | Fitchett et al. | |
| 2013/0072324 | A1 | 3/2013 | Tarao et al. | |
| 2014/0066229 | A1 * | 3/2014 | Kuntimaddi | B05B 15/045 473/378 |

FOREIGN PATENT DOCUMENTS

| | | | |
|---|---|---|---|
| DE | 20118765 | U1 | 1/2002 |
| EP | 2500105 | A1 | 9/2012 |
| JP | 01307468 | A | 12/1989 |
| JP | 08318186 | A | 12/1996 |

* cited by examiner

*Primary Examiner* — Michael P Rodriguez
(74) *Attorney, Agent, or Firm* — Quinn Law Group, PLLC

(57) ABSTRACT

A method of forming a coating layer on a golf ball includes spraying a first quantity of a coating composition onto the golf ball to form a partially-coated golf ball that has a first pole disposed in a top position, a second pole disposed in a bottom position, a diameter extending between the first and second poles, and an axis of rotation perpendicular to the diameter. After spraying the first quantity, the method includes rotating the partially-coated golf ball about the axis to translate the first and second poles such that the first pole is disposed in the bottom position and the second pole is disposed in the top position. After rotating, the method includes spraying a second quantity of the composition onto the partially-coated golf ball to form the coating layer on the golf ball. An apparatus for forming the coating layer on the golf ball is also disclosed.

13 Claims, 4 Drawing Sheets

METHOD OF AND APPARATUS FOR FORMING A COATING LAYER ON A GOLF BALL

TECHNICAL FIELD

The disclosure relates to a method of and apparatus for forming a coating layer on a golf ball.

BACKGROUND

Golf balls generally include a core and a durable cover surrounding the core. The durable cover may be coated with a cured coating layer formed from a coating composition. The cured coating layer may provide the golf ball with specific characteristics such as color, gloss, durability, and spin during flight.

SUMMARY

A method of forming a coating layer on a golf ball includes spraying a first quantity of a coating composition onto the golf ball to form a partially-coated golf ball. The partially-coated golf ball has a first pole disposed in a top position, wherein the top position is spaced apart from a ground plane by a first distance, and a second pole disposed in a bottom position, wherein the bottom position is spaced apart from the ground plane by a second distance that is less than the first distance. The partially-coated golf ball also has a diameter extending between the first pole and the second pole, and an axis of rotation perpendicular to the diameter. The axis of rotation intersects the diameter at a midpoint between the first pole and the second pole. The method also includes, after spraying the first quantity, rotating the partially-coated golf ball about the axis of rotation to translate the first pole and the second pole such that the first pole is disposed in the bottom position and the second pole is disposed in the top position. After rotating, the method includes spraying a second quantity of the coating composition onto the partially-coated golf ball to form the coating layer on the golf ball.

In this embodiment, the partially-coated golf ball has a partially-coated surface and a first equator defined by a first plane that is perpendicular to the diameter and intersects the partially-coated surface. The first equator circumnavigates the partially-coated surface and is equidistant from the first pole and the second pole. Therefore, the partially-coated golf ball also has a first hemisphere and a second hemisphere spaced apart from the first hemisphere by the first equator. The first pole is disposed within the first hemisphere, and the second pole is disposed within the second hemisphere.

The partially-coated golf ball also has a second equator defined by a second plane that is perpendicular to the axis of rotation and intersects the partially-coated surface. The second equator circumnavigates the partially-coated surface through the first pole and the second pole and intersects the first equator. As such, the golf ball has a third hemisphere and a fourth hemisphere spaced apart from the third hemisphere by the second equator.

In one example, rotating includes disposing the partially-coated golf ball between at least two needles such that the at least two needles abut the partially-coated golf ball on the first equator. For example, rotating may include disposing the partially-coated golf ball between four needles.

In particular, rotating may include disposing a first pair of two needles on the first equator and disposing a second pair of two needles substantially opposite the first pair on the first equator. The first pair of two needles may be attached to a first plate and the second pair of two needles may be attached to a second plate spaced apart from the first plate. For this example, rotating includes clamping the partially-coated golf ball between four needles so that the partially-coated golf ball does not spin with respect to the four needles as the first pole translates from the top position to the bottom position. Further, rotating includes concurrently turning each of the first plate and the second plate approximately 180° about the axis of rotation.

In another example, rotating includes disposing the partially-coated golf ball between two needles such that the two needles abut the partially-coated golf ball between the first equator and the second pole and are disposed substantially opposite one another. For this example, rotating includes disposing a first needle within the second hemisphere and the third hemisphere, and disposing a second needle substantially opposite the first needle within the second hemisphere and the fourth hemisphere.

Rotating includes clamping the partially-coated golf ball between the two needles so that the partially-coated golf ball spins with respect to the two needles as the first pole translates from the top position to the bottom position. For example, a first needle may be attached to the first plate and a second needle may be attached to the second plate spaced apart from the first plate. For this example, rotating includes moving the partially-coated golf ball such that the first pole translates from the top position to the bottom position and each of the first plate and the second plate does not rotate about the axis of rotation. That is, rotating includes translating the first pole and the second pole approximately 180° about the axis of rotation.

In one embodiment, the method also includes, after spraying the second quantity, revolving the partially-coated golf ball about the axis of rotation to translate the first pole and the second pole such that the first pole is again disposed in the top position and the second pole is again disposed in the bottom position to form the coating layer on the golf ball.

For example, revolving may include disposing a first pair of two needles on the first equator and disposing a second pair of two needles substantially opposite the first pair on the first equator. For this example, revolving includes clamping the partially-coated golf ball between four needles so that the partially-coated golf ball does not spin with respect to the four needles as the first pole translates from the bottom position to the top position. Alternatively, in another example, revolving includes disposing the partially-coated golf ball between two needles such that the two needles abut the partially-coated golf ball within the first hemisphere and are disposed substantially opposite one another. Revolving includes substantially evenly distributing the coating composition on the golf ball.

An apparatus for forming the coating layer on the golf ball includes a conveyor translatable along the longitudinal axis that is substantially parallel to the ground plane. The apparatus also includes a rotation device spaced apart from the conveyor and translatable along a vertical axis that is perpendicular to the longitudinal axis. Further, the rotation device includes the first plate, the second plate spaced apart from the first plate, and at least one needle extending from each of first plate and the second plate.

The apparatus may further include a tripod extending from the conveyor and configured for supporting the golf ball, and the rotation device may be alternatingly translatable towards and away from the tripod along the vertical axis. The rotation device may include a first needle extending from the first plate and a second needle extending from the second plate. In another example, the rotation device may include a first pair of two needles extending from the first plate and a second pair of two needles extending from the second plate.

The coating layer formed by the method and apparatus has a substantially even thickness at every point on the golf ball. That is, the coating layer evenly coats or covers a substantial entirety of the golf ball. As such, the golf ball is generally free from unevenly-coated or non-coated portions, and the method and apparatus may minimize deformation or sag of the coating layer during subsequent manufacturing operations such as curing or drying of the coating layer.

Therefore, the method and apparatus are economical and produce golf balls having excellent physical properties. In particular, a cured coating layer formed from the coating layer has excellent adhesion to the golf ball. As such, the cured coating layer may not peel, delaminate, or chip when the golf ball is exposed to sunlight or used during prolonged play. In addition, golf balls formed by the method have excellent gloss, color, durability, and spin during flight.

As used herein, directional terminology pertaining to the golf ball or movement of the golf ball such as "top," "above," "bottom," and "beneath" describes conventional relative locations with respect to a reference point, such as a playing surface, the longitudinal axis, or a ground plane, i.e., the ground. For example, terminology such as "top" and "above" generally refers to a superior portion or direction of the golf ball with respect to the playing surface, longitudinal axis, or ground plane. Conversely, terminology such as "bottom" and "beneath" generally refers to an inferior portion or direction of the golf ball with respect to the superior portion or direction of the golf ball, playing surface, longitudinal axis, or ground plane. Likewise, terminology such as "upside down" refers to an inversion of positions of the golf ball with respect to the playing surface, longitudinal axis, or ground plane.

In addition, as used herein, the terms "a," "an," "the," "at least one," and "one or more" are interchangeable and indicate that at least one of an item is present. A plurality of such items may be present unless the context clearly indicates otherwise. All numerical values of parameters, quantities, or conditions in this disclosure, including the appended claims, are to be understood as being modified in all instances by the term "about" or "approximately" whether or not "about" or "approximately" actually appears before the numerical value. "About" and "approximately" indicate that the stated numerical value allows some slight imprecision (e.g., with some approach to exactness in the value; reasonably close to the value; nearly; essentially). If the imprecision provided by "about" or "approximately" is not otherwise understood with this meaning, then "about" and "approximately" as used herein indicate at least variations that may arise from methods of measuring and using such parameters. Further, the terminology "substantially" also refers to a slight imprecision of a condition (e.g., with some approach to exactness of the condition; approximately or reasonably close to the condition; nearly; essentially). In addition, disclosed ranges include disclosure of all values and further divided ranges within the entire range. Each value within a range and the endpoints of a range are all disclosed as separate embodiments. In this disclosure, for convenience, "polymeric" and "resinous" are used interchangeably to encompass resins, oligomers, and polymers. The terms "comprises," "comprising," "includes," "including," "has," and "having" are inclusive and therefore specify the presence of stated items, but do not preclude the presence of other items. As used in this disclosure, the term "or" includes any and all combinations of one or more of the listed items. When the terms "first," "second," "third," etc. are used to differentiate various items from one another, these designations are merely for convenience and do not limit the items.

The above features and advantages and other features and advantages of the present disclosure will be readily apparent from the following detailed description of the preferred embodiments and best modes for carrying out the present disclosure when taken in connection with the accompanying drawings and appended claims.

DETAILED DESCRIPTION

Figure 1:
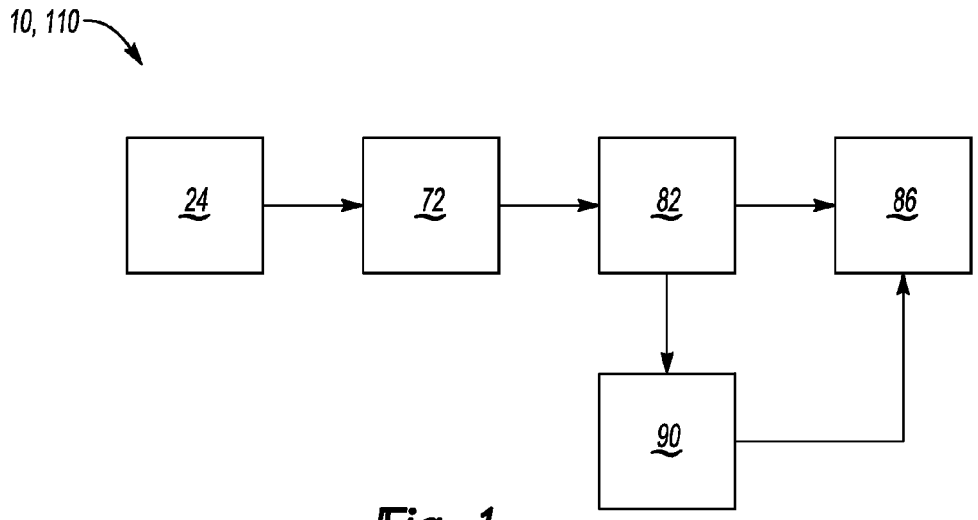
FIG. 1 is a flowchart of a method of forming a coating layer on a golf ball.
Figure 2:
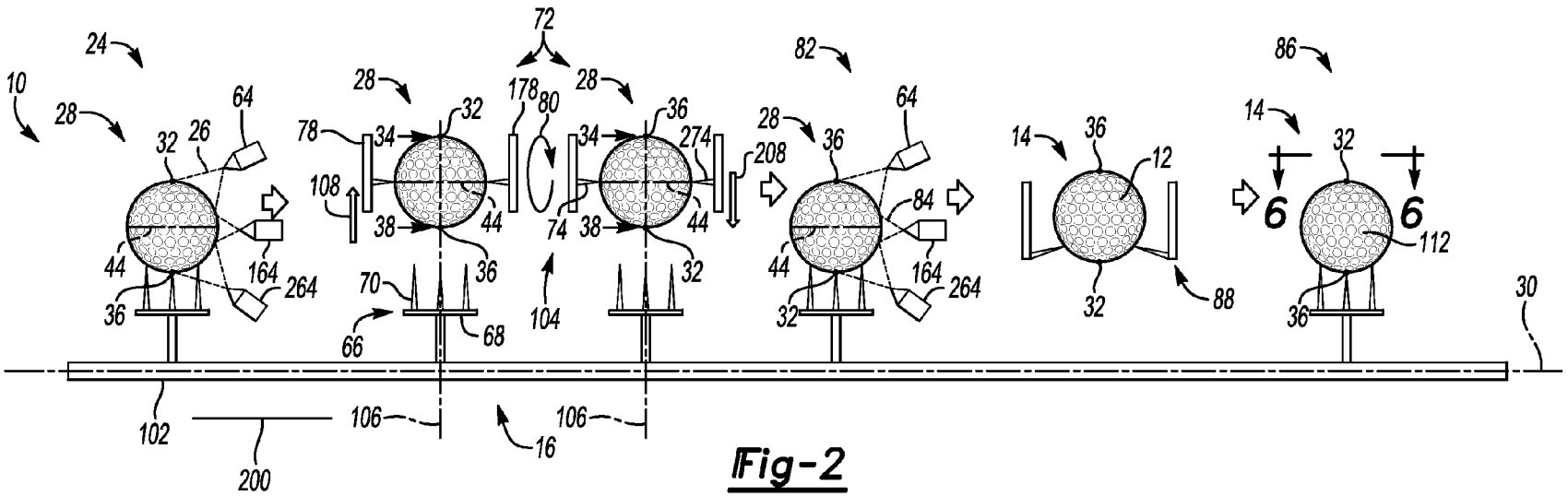
FIG. 2 is a schematic illustration of the method of FIG. 1, wherein exemplary operations of the method are illustrated generally in side view.

Referring to the Figures, wherein like reference numerals refer to like elements, a method 10, 110 of forming a coating layer 12 (FIG. 6) on a golf ball 14 (FIG. 2) is shown generally in FIGS. 1 and 2, and an apparatus 16 for forming the coating layer 12 on the golf ball 14 is illustrated generally in FIG. 2. As described in more detail below, the golf ball 14 may include an external surface 18 (FIG. 6) of a cover 94 (FIG. 6) and the coating layer 12 (FIG. 6) disposed on the external surface 18. The coating layer 12 evenly covers and coats a substantial entirety of the external surface 18 and has a substantially uniform thickness 20 (FIG. 6) at every point or location on the external surface 18. That is, the coating layer 12 should evenly coat or cover the external surface 18 such that the external surface 18 is generally free from unevenly-coated or non-coated portions (indicated generally at 22 in FIG. 3). The method 10, 110 and apparatus 16 facilitate even coating of the golf ball 14 and minimize deformation or sag of the coating layer 12 during manufacture of the golf ball 14. As such, the golf ball 14 formed by the method 10, 110 and apparatus 16 may exhibit excellent durability and appearance over an operating life.

Figure 3:
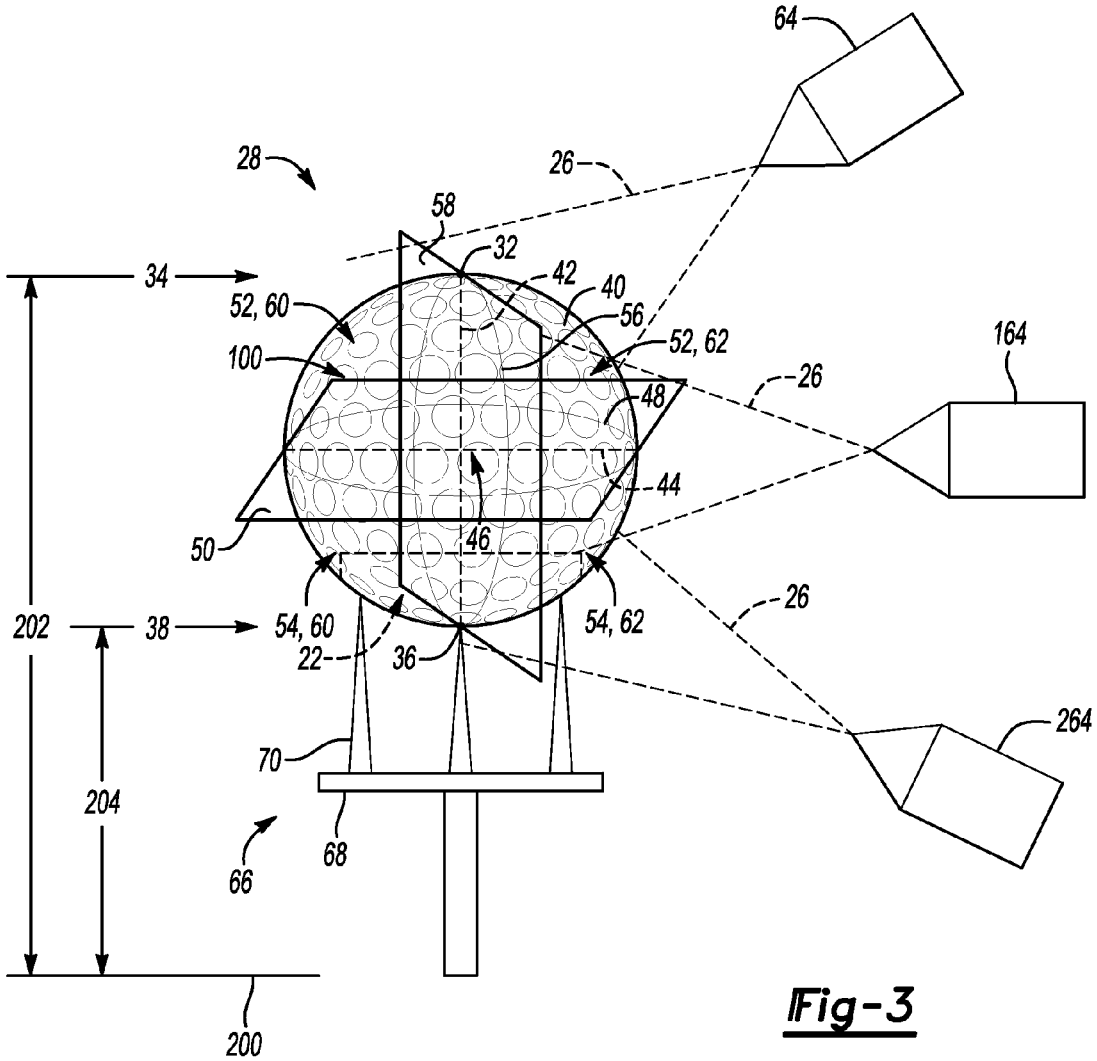
FIG. 3 is a schematic illustration of a side view of a spraying operation of the method of FIGS. 1 and 2.

Referring again to FIGS. 1 and 2, the method 10, 110 of forming the coating layer 12 on the golf ball 14 includes spraying 24 a first quantity 26 (FIG. 2) of a coating composition onto the golf ball 14 to form a partially-coated golf ball 28 (FIG. 2). As best shown in FIG. 3, the partially-coated golf ball 28 has a first pole 32 disposed in a top position 34, wherein the top position 34 is spaced apart from a ground plane 200 by a first distance 202, and a second pole 36 disposed in a bottom position 38, wherein the bottom position 38 is spaced apart from the ground plane 200 by a second distance 204 that is less than the first distance 202. For example, the first pole 32 may be disposed at a top or superior portion of the partially-coated golf ball 28, i.e., the top position 34 may correspond to the top of the partially-coated golf ball 28 and may be farthest from the ground plane 200. Conversely, the second pole 36 may be disposed directly across from the first pole 32 at a bottom or inferior portion of the partially-coated golf ball 28, i.e., the bottom position 38 may correspond to the bottom of the partially-coated golf ball 28 and may be closer to the ground plane 200 than the top position 34. Further, the partially-coated golf ball 28 may have a partially-coated surface 40 as set forth in more detail below.

In addition, the partially-coated golf ball 28 has a diameter 42 extending between the first pole 32 and the second pole 36. The partially-coated golf ball 28 also has an axis of rotation 44 perpendicular to the diameter 42, wherein the axis of rotation 44 intersects the diameter 42 at a midpoint 46 between the first pole 32 and the second pole 36. That is, the axis of rotation 44 bisects the diameter 42 midway between the first pole 32 and the second pole 36 to cut the diameter 42 into two portions or halves each having an equal length. Stated differently, the axis of rotation 44 intersects the diameter 42 at a center of the partially-coated golf ball 28.

Further, the partially-coated golf ball 28 may also have a first equator 48 defined by a first plane 50 that is perpendicular to the diameter 42 and intersects the partially-coated surface 40. The first equator 48 circumnavigates the partially-coated surface 40 and is equidistant from the first pole 32 and the second pole 36. In other words, the first equator 48 forms a circle or beltline about the partially-coated surface 40 at a latitude exactly midway between the first pole 32 and the second pole 36.

Therefore, the partially-coated golf ball 28 may also have a first hemisphere 52, wherein the first pole 32 is disposed within the first hemisphere 52. Similarly, the partially-coated golf ball 28 may have a second hemisphere 54 spaced apart from the first hemisphere 52 by the first equator 48, wherein the second pole 36 is disposed within the second hemisphere 54.

The partially-coated golf ball 28 may also have a second equator 56 defined by a second plane 58 that is perpendicular to the axis of rotation 44 and intersects the partially-coated surface 40. That is, the second equator 56 circumnavigates the partially-coated surface 40 through the first pole 32 and the second pole 36 and intersects the first equator 48. As such, the second equator 56 bisects the partially-coated surface 40. However, in contrast to the first equator 48 which may not extend through the first pole 32 and the second pole 36, the second equator 56 may extend through the first pole 32 and the second pole 36. Stated differently, the second equator 56 forms a circle or beltline about the partially-coated surface 40 at a longitude extending through the first pole 32 and the second pole 36. Therefore, the partially-coated golf ball 28 may further have a third hemisphere 60 and a fourth hemisphere 62 spaced apart from the third hemisphere 60 by the second equator 56.

Referring again to the method 10, 110 and FIG. 2, the first quantity 26 of the coating composition may be sprayed from one or more spray guns 64 onto the golf ball 14. In one variation, the coating composition may be sprayed from three spray guns 64, 164, 264 each arranged to coat a specific portion of the golf ball 14. For example, as shown in FIG. 3, a first spray gun 64 may spray the coating composition onto the golf ball 14 near the first pole 32, a second spray gun 164 may spray the coating composition onto the golf ball 14 near the first equator 48, and a third spray gun 264 may spray the coating composition onto the golf ball 14 near the second pole 36.

Alternatively, in another variation, although not shown, the first quantity 26 of the coating composition may be sprayed from one spray gun 64 that is configured to oscillate between the first pole 32 and the second pole 36 during spraying 24. That is, the spray gun 64 may translate between the first pole 32 and the second pole 36 to follow an arced path and coat the golf ball 14 with the first quantity 26 of the coating composition.

During spraying 24, it is to be appreciated that the first quantity 26 of the coating composition may not evenly coat or cover each portion of the golf ball 14. For example, as best shown in FIG. 3, less of the first quantity 26 of the coating composition may be disposed on the second pole 36 of the partially-coated golf ball 28 than on the first pole 32 and/or the first equator 48. For example, an element of the apparatus 16 (FIG. 2), such as a tripod 66 that may support the golf ball 14, may obstruct, block, or prevent the coating composition from depositing onto an entirety of the partially-coated golf ball 28 at the second pole 36.

That is, the apparatus 16 may include the tripod 66 configured for supporting the partially-coated golf ball 28 and/or the golf ball 14 during various stages of manufacture. The tripod 66 may include a platform 68 and a plurality of spires 70, e.g., three spires 70, each extending from the platform 68. The partially-coated golf ball 28 and the golf ball 14 may therefore be supported by and rest upon the tripod 66 during formation of the coating layer 12.

Consequently, the plurality of spires 70 and/or the platform 68 may mask a portion of the golf ball 14 during spraying 24, and may prevent deposition of the first quantity 26 of the coating composition onto the golf ball 14. As such, spraying 24 the first quantity 26 forms the partially-coated golf ball 28 having the partially-coated surface 40. Therefore, as used herein, the terminology "partially-coated golf ball 28" may refer to a golf ball 14 including a coating having an uneven thickness in two separate areas or locations.

Referring again to FIGS. 1 and 2, after spraying 24 the first quantity 26, the method 10, 110 includes rotating 72 the partially-coated golf ball 28 about the axis of rotation 44 to translate the first pole 32 and the second pole 36 such that the first pole 32 is disposed in the bottom position 38 and the second pole 36 is disposed in the top position 34. That is, rotating 72 may include flipping the partially-coated golf ball 28 over about the axis of rotation 44 so that the first pole 32 translates from the top position 34, e.g., the top of the partially-coated golf ball 28, to the bottom position 38, e.g., the bottom of the partially-coated golf ball 28. That is, rotating 72 may include translating the first pole 32 and the second pole 36 approximately 180° about the axis of rotation 44.

Figure 4B:
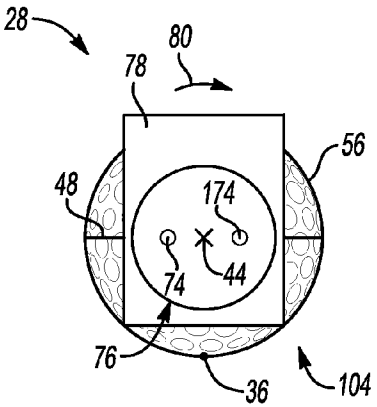
FIG. 4B is a schematic illustration of an end view of the rotation device of FIG. 4A.
Figure 4A:
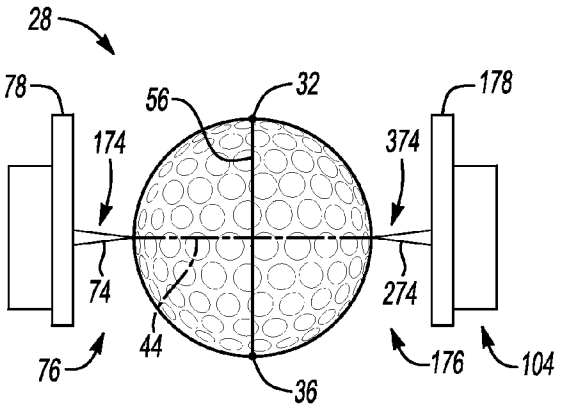
FIG. 4A is a schematic illustration of a side view of a rotation device of an apparatus for forming the coating layer on the golf ball.
Figure 4C:
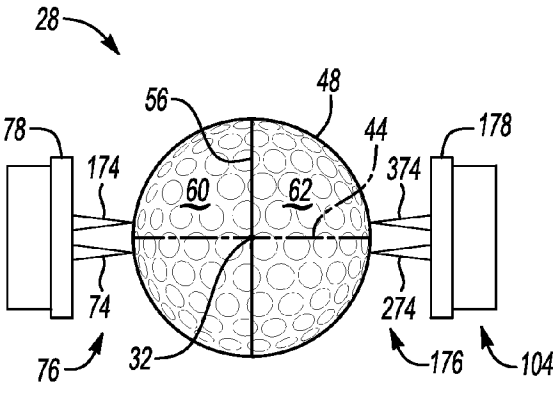
FIG. 4C is a schematic illustration of a top view of the rotation device of FIG. 4A.

Referring now to FIGS. 4A-4C, in a first example, rotating 72 (FIG. 1) includes disposing the partially-coated golf ball 28 between at least two needles 74, 274 such that the at least two needles 74, 274 abut the partially-coated golf ball 28 on the first equator 48 (FIG. 4B). For example, rotating 72 may include disposing the partially-coated golf ball 28 between four needles 74, 174, 274, 374. Non-limiting examples of such needles 74, 174, 274, 374 include tacks, lances, prongs, and other acicular objects. As best shown in FIG. 4C, rotating 72 includes disposing a first pair 76 of two needles 74, 174 on the first equator 48 and disposing a second pair 176 of two needles 274, 374 substantially opposite or across from the first pair on the first equator 48. That is, rotating 72 includes disposing the first pair 76 on the first equator 48 within the third hemisphere 60 and disposing the second pair 176 on the first equator 48 within the fourth hemisphere 62.

Further, rotating 72 includes clamping the partially-coated golf ball 28 between four needles 74, 174, 274, 374 so that the partially-coated golf ball 28 does not spin with respect to the four needles 74, 174, 274, 374 as the first pole 32 translates from the top position 34 (FIG. 2) to the bottom position 38 (FIG. 2). That is, the first pair 76 of two needles 74, 174 may be attached to a first plate 78 and the second pair 176 of two needles 274, 374 may be attached to a second plate 178 spaced apart from the first plate 78. As such, rotating 72 may include concurrently turning each of the first plate 78 and the second plate 178 approximately 180° about the axis of rotation 44. That is, the first plate 78 and the second plate 178 may each rotate with respect to the tripod 66 (FIG. 2).

For this embodiment, the partially-coated golf ball 28 remains stationary or fixed with respect to the first plate 78 and the second plate 178. However, the first and second plates 78, 178 may together rotate the partially-coated golf ball 28 about the axis of rotation 44 to thereby flip the partially-coated golf ball 28 over and dispose the partially-coated golf ball 28 upside down. For example, the first and second plates 78, 178 may rotate the partially-coated golf ball 28 in a direction of arrow 80 (FIG. 4B) or in a direction (not shown) opposite the direction of arrow 80, and dispose the first pole 32 in the bottom position 38 (FIG. 2). Such rotating 72 may therefore prepare the partially-coated golf ball 28 for subsequent manufacturing operations, and may prevent the partially-coated golf ball 28 from spinning about the axis of rotation 44 with respect to the first and second plates 78, 178.

Figure 5C:
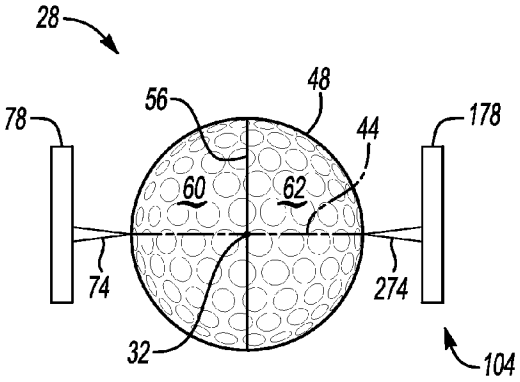
FIG. 5C is a schematic illustration of a top view of the rotation device of FIG. 5A.
Figure 5B:
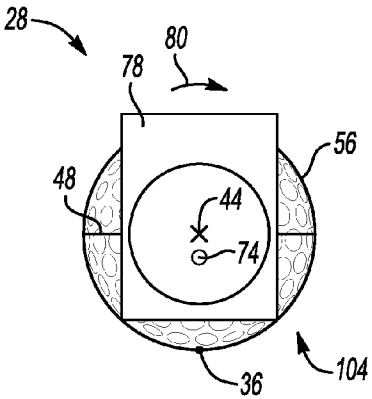
FIG. 5B is a schematic illustration of an end view of the rotation device of FIG. 5A.
Figure 5A:
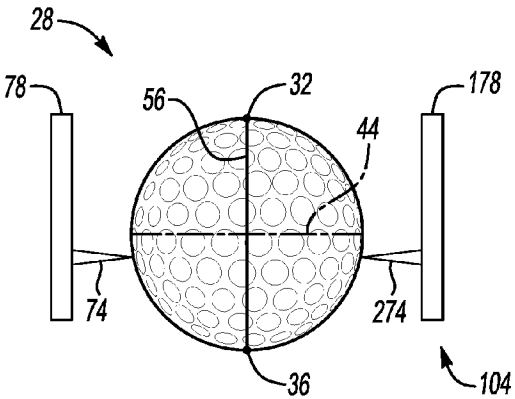
FIG. 5A is a schematic illustration of a side view of another embodiment of the rotation device of FIG. 4A.

Referring now to FIGS. 5A-5C, in another embodiment, rotating 72 includes disposing the partially-coated golf ball 28 between two needles 74, 274 such that the two needles 74, 274 abut the partially-coated golf ball 28 between the first equator 48 (FIG. 5B) and the second pole 36 and are disposed substantially opposite one another, i.e., are disposed directly across from one another with respect to the diameter 42. As best shown in FIGS. 5B and 5C, for this embodiment, rotating 72 includes disposing the partially-coated golf ball 28 between two needles 74, 274 at a latitude beneath the first equator 48, i.e., at a latitude between the first equator 48 and the second pole 36. That is, rotating 72 includes disposing a first needle 74 within the second hemisphere 54 and the third hemisphere 60, and disposing a second needle 274 within the second hemisphere 54 and the fourth hemisphere 62.

For this embodiment, rotating 72 includes clamping the partially-coated golf ball 28 between the two needles 74, 274 so that the partially-coated golf ball 28 spins with respect to the two needles 74, 274 as the first pole 32 translates from the top position 34 (FIG. 2) to the bottom position 38 (FIG. 2). The first needle 74 may be attached to the first plate 78 and the second needle 274 may be attached to the second plate 178. For this embodiment, the first plate 78 and the second plate 178 are stationary plates and are not rotatable with respect to the tripod 66 (FIG. 2).

Rotating 72 includes moving the partially-coated golf ball 28 such that the first pole 32 translates from the top position 34 (FIG. 2) to the bottom position 38 (FIG. 2) and each of the first plate 78 and the second plate 178 does not rotate about the axis of rotation 44. That is, since the two needles 74, 274 are not disposed along the first equator 48 for this embodiment, the partially-coated golf ball 28 may spin with respect to the first and second plates 78, 178, e.g., due to potential energy and gravity.

Stated differently, disposing the two needles 74, 274 between the first equator 48 and the second pole 36 causes the partially-coated golf ball 28 to be rotationally unbalanced between the first and second plates 78, 178. With a center of gravity of the partially-coated golf ball 28 disposed along the first equator 48, the partially-coated golf ball 28 tips and spins such that the first pole 32 translates from the top position 34 (FIG. 2) to the bottom position 38 (FIG. 2) when the partially-coated golf ball 28 is moved. In other words, since the center of gravity of the partially-coated golf ball 28 is disposed above the two needles 74, 274, a potential energy resulting from the relative location of the center of gravity with respect to the two needles 74, 274 transforms to a kinetic energy so that the partially-coated golf ball 28 rotates about the first equator 48 so that the first pole 32 is disposed in the bottom position 38.

By way of non-limiting examples, moving the partially-coated golf ball 28 may include nudging or vibrating the partially-coated golf ball 28 slightly to begin translation of the first pole 32 from the top position 34 (FIG. 2) to the bottom position 38 (FIG. 2). For example, moving may include directing a quantity of air (not shown) at the partially-coated golf ball 28. Alternatively or additionally, moving may include vibrating or wobbling both the first plate 78 and the second plate 178 to begin translation of the first pole 32 to the bottom position 38.

In FIG. 2, the method 10 also includes, after rotating 72, spraying 82 a second quantity 84 of the coating composition onto the partially-coated golf ball 28 to form the coating layer 12 on the golf ball 14. The coating layer 12 is substantially evenly disposed on the external surface 18 (FIG. 6) and is formed from the first quantity 26 and the second quantity 84.

The second quantity 84 of the coating composition may be sprayed from one or more spray guns 64. For example, in one variation, the second quantity 84 may be sprayed from three spray guns 64, 164, 264, each arranged to coat a specific portion of the partially-coated golf ball 28. For example, the first spray gun 64 may spray the coating composition onto the partially-coated golf ball 28 near the second pole 36 disposed in the top position 34, the second spray gun 164 may spray the coating composition onto the partially-coated golf ball 28 near the first equator 48 (FIG. 3), and the third spray gun 264 may spray the coating composition onto the partially-coated golf ball 28 near the first pole 32 disposed in the bottom position 38.

Alternatively, although not shown, the second quantity 84 of the coating composition may be sprayed from one spray gun 64 configured to oscillate between the second pole 36 and the first pole 32 during spraying 82. That is, the spray gun 64 may translate along the partially-coated golf ball 28 between the second pole 36 and the first pole 32 to follow an arced path and coat the partially-coated golf ball 28 with the second quantity 84 of the coating composition.

The second quantity 84 of the coating composition evenly coats or covers each portion of the external surface 18 (FIG. 6) of the golf ball 14. For example, the second quantity 84 may cover or coat a portion of the partially-coated surface 40 (FIG. 3) which was not covered or coated by the first quantity 26 of the coating composition during spraying 24. In this way, the method 10, 110 forms the coating layer 12 having a substantially uniform thickness 20 (FIG. 6) at each point along the external surface 18 of the golf ball 14, i.e., within the first hemisphere 52 (FIG. 3), the second hemisphere 54 (FIG. 3), the third hemisphere 60 (FIG. 3), and the fourth hemisphere 62 (FIG. 3), and along the first equator 48 (FIG. 3) and the second equator 56 (FIG. 3).

The coating composition may be any coating composition suitable for golf balls 14. For example, the coating composition may be a primer coating composition, a topcoat coating composition, a clearcoat coating composition, or a combination of these coating compositions. Suitable topcoat coating compositions include polyurethane coating compositions, polyurea coating compositions, acrylic coating compositions, vinyl coating compositions, polyester coating compositions, polyether coating compositions, epoxy coating compositions, melamine coating compositions, and combinations of these coating compositions. For example, the coating composition may be a polyester-polyurethane coating composition, an acrylic-polyurethane coating composition, or a polyether-polyurethane coating composition. In one non-limiting example, the coating composition is a waterborne polyurethane coating composition. The coating composition includes a polymeric component or resinous vehicle such as a polyurethane, a polyurea, an acrylic, a vinyl, a polyester, a polyether, an epoxy, a melamine, and combinations thereof. In a thermosetting coating composition, a vehicle polymer may include functional groups such as, but not limited to, hydroxyl functional groups, carboxyl functional groups, carbamate functional groups, urea functional groups, epoxide functional groups, primary amine functional groups, secondary amine functional groups, amido functional groups, thiol functional groups, silane functional groups, and combinations of these functional groups, and a crosslinker reactive with the functional groups under curing conditions.

Figure 6:
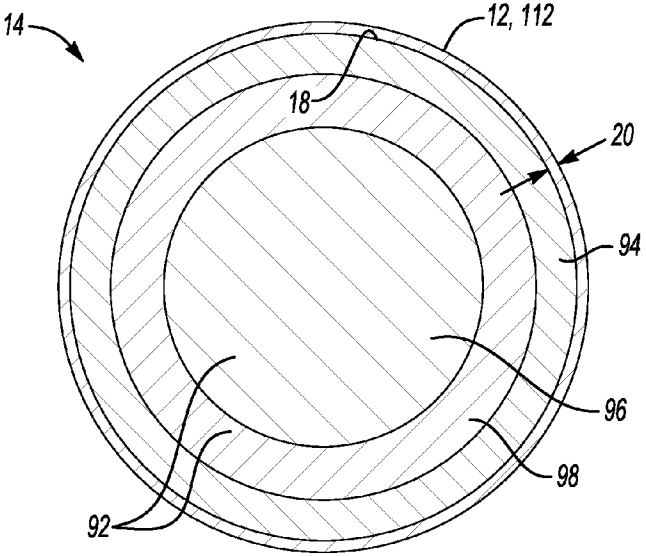
FIG. 6 is a schematic illustration of a cross-sectional view of the golf ball formed by the method of FIG. 1, taken along section lines 6-6.

Referring again to FIG. 1, the method 10, 110 may further include, after spraying 82 the second quantity 84, curing 86 the first quantity 26 and the second quantity 84 to form a cured coating layer 112 (FIG. 6) disposed on the external surface 18 (FIG. 6). For example, curing 86 may include heating the coating composition at a temperature of from about 55° C. to about 80° C. for a duration of from about 10 minutes to about 4 hours. More specifically, curing 86 may include heating the coating composition at a temperature of about 65° C. for a duration of about 20 minutes. Curing 86 may also include transferring the golf ball 14 including the coating layer 12 disposed on the external surface 18 to a baking oven, for example, by a transfer device (shown generally at 88 in FIG. 2).

Figure 7:
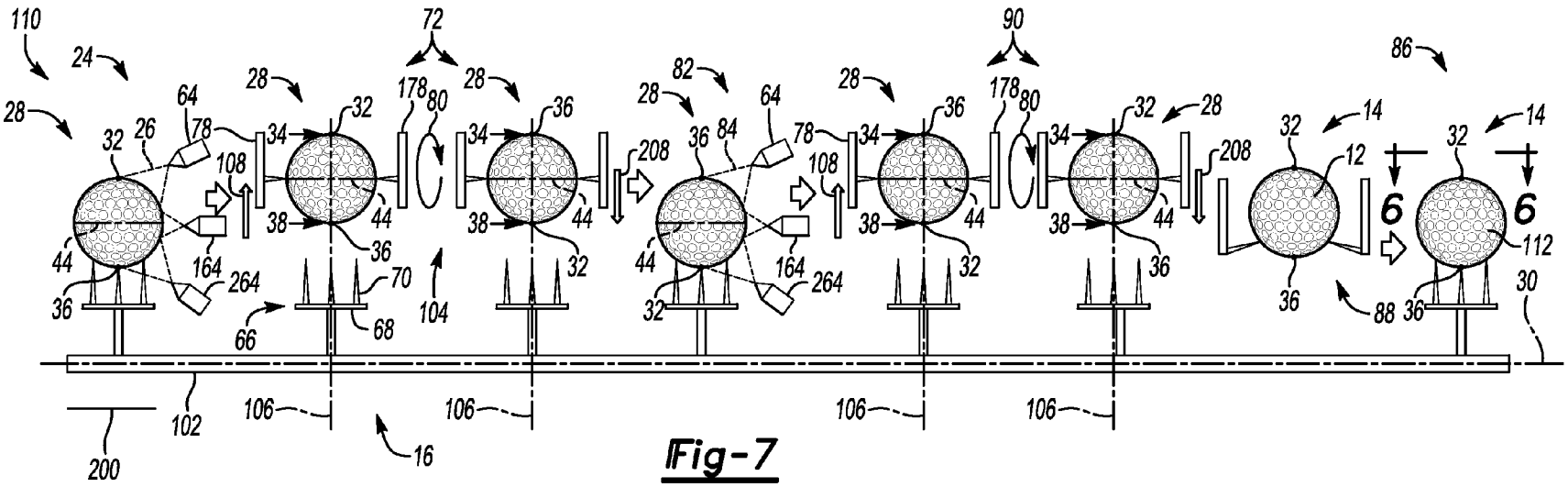
FIG. 7 is a schematic illustration of another embodiment of the method of FIG. 1, wherein exemplary operations of the method are illustrated generally in side view.

FIG. 7 illustrates another embodiment in which the method 110 includes, after spraying 82 the second quantity 84, revolving 90 the partially-coated golf ball 28 about the axis of rotation 44 to translate the first pole 32 and the second pole 36 such that the first pole 32 is again disposed in the top position 34 and the second pole 36 is again disposed in the bottom position 38 to form the coating layer 12 on the golf ball 14. That is, revolving 90 includes re-orienting the partially-coated golf ball 28 such that the first pole 32 is again disposed in the top position 34 and the second pole 36 is again disposed in the bottom position 38. Stated differently, revolving 90 includes translating the first pole 32 from the bottom position 38 to the top position 34 and translating the second pole 36 from the top position 34 to the bottom position 38 to form the coating layer 12 on the golf ball 14.

The method 110 maximizes a uniformity of thickness 20 (FIG. 6) of the coating layer 12, and conversely minimizes any portions of the coating layer 12 having a comparatively uneven thickness. For example, revolving 90 may be useful for controlling the thickness 20 of the coating layer 12 immediately after spraying 82 the second quantity 84. That is, after spraying 82 the second quantity 84, the coating layer 12 may still be uncured and have a liquid state. Without revolving 90, the uncured coating layer 12 may sag or flow toward the first pole 32, e.g., toward the bottom of the partially-coated golf ball 28, under gravity and may cause an uneven distribution of the coating layer 12 on the partially-coated golf ball 28. Revolving 90 may compensate for such uneven distribution and/or flow of the coating layer 12 by reversing an orientation of the partially-coated golf ball 28 such that the first pole 32 reverts and translates from the bottom position 38 to the top position 34. Therefore, revolving 90 may include substantially evenly distributing the coating composition on the golf ball 14.

In one example as described with reference to FIGS. 4A-4C, revolving 90 includes disposing the first pair 76 of two needles 74, 174 on the first equator 48 (FIG. 4B) and disposing the second pair 176 of two needles 274, 374 substantially opposite the first pair 76 on the first equator 48. As shown in FIG. 4C, revolving 90 includes disposing two needles 74, 174 on the first equator 48 within the third hemisphere 60 and disposing two needles 274, 374 on the first equator 48 within the fourth hemisphere 62.

For this example, revolving 90 includes clamping the partially-coated golf ball 28 between four needles 74, 174, 274, 374 so that the partially-coated golf ball 28 does not spin with respect to the four needles 74, 174, 274, 374 as the first pole 32 translates from the bottom position 38 (FIG. 2) to the top position 34 (FIG. 2). The first pair 76 of the four needles 74, 174 may be attached to the first plate 78 and the second pair 176 of the four needles 274, 374 may be attached to the second plate 178 spaced apart from the first plate 78.

In this example, revolving 90 includes concurrently turning each of the first plate 78 and the second plate 178 approximately 180° about the axis of rotation 44. That is, in this example, the partially-coated golf ball 28 remains stationary or fixed with respect to the first plate 78 and the second plate 178, and the first and second plates 78, 178 rotate the partially-coated golf ball 28 about the axis of rotation 44 to thereby flip the partially-coated golf ball 28 over, i.e., upside down, and again dispose the first pole 32 in the top position 34. Such revolving 90 may therefore prepare the golf ball 14 for subsequent manufacturing operations, such as curing 86 (FIG. 7).

In another example, revolving 90 includes disposing the partially-coated golf ball 28 between two needles 74, 274 such that the two needles 74, 274 abut the partially-coated golf ball 28 within the first hemisphere 52 (FIG. 3), e.g., between the first equator 48 and the first pole 32, and are disposed substantially opposite one another. That is, the two needles 74, 274 are arranged within the first hemisphere 52 to be substantially directly across from one another with respect to the diameter 42. Revolving 90 includes disposing the partially-coated golf ball 28 between two needles 74, 274 beneath the axis of rotation 44 between the first equator 48 and the first pole 32, i.e., beneath the first equator 48. That is, revolving 90 includes disposing the first needle 74 within the third hemisphere 60 (FIG. 3) and disposing the second needle 274 within the fourth hemisphere 62 (FIG. 3).

Revolving 90 includes clamping the partially-coated golf ball 28 between the two needles 74, 274 so that the partially-coated golf ball 28 spins with respect to the two needles 74, 274 as the first pole 32 again translates from the bottom position 38 (FIG. 7) to the top position 34 (FIG. 7). In particular, the first needle 74 may be attached to the first plate 78 and the second needle 274 may be attached to the second plate 178. Therefore, revolving 90 includes moving the partially-coated golf ball 28 such that the first pole 32 translates from the bottom position 38 to the top position 34 and each of the first plate 78 and the second plate 178 does not rotate about the first equator 48. That is, for this embodiment, since the two needles 74, 274 are not disposed along the first equator 48, the partially-coated golf ball 28 spins with respect to the first and second plates 78, 178.

Stated differently, since each of the two needles 74, 274 is disposed between the first equator 48 and the first pole 32, the partially-coated golf ball 28 is rotationally unbalanced between the first and second plates 78, 178. With a center of gravity of the partially-coated golf ball 28 disposed along the first equator 48, the partially-coated golf ball 28 tips and spins such that the first pole 32 translates from the bottom position 38 to the top position 34 after moving the partially-coated golf ball 28. Stated differently, since the center of gravity of the partially-coated golf ball 28 is disposed above the two needles 74, 274, a potential energy resulting from the relative location of the center of gravity with respect to the two needles 74, 274 transforms to a kinetic energy so that the partially-coated golf ball 28 revolves about the axis of rotation 44 such that the first pole 32 is again disposed in the top position 34.

By way of non-limiting examples, moving may include nudging or vibrating the partially-coated golf ball 28 slightly to begin translation of the first pole 32 from the bottom position 38 to the top position 34. For example, moving may include directing a quantity of air (not shown) at the partially-coated golf ball 28. Alternatively or additionally, moving may include vibrating or wobbling both the first plate 78 and the second plate 178 to begin translation of the first pole 32 to the top position 34.

Referring now to FIG. 6, the resulting golf ball 14 formed by the method 10, 110 may include a core 92 and the cover 94 disposed on the core 92. That is, the golf ball 14 may have a multi-layer construction such that the cover 94 may enclose the core 92. Further, the core 92 may be an elastic center of the golf ball 14 and may include a core center 96 and one or more core layers 98 disposed on the core center 96. While FIG. 6 generally illustrates a golf ball 14 having a three-piece construction, i.e., the core center 96, one core layer 98, and the cover 94, the described structure, method 10, 110, and apparatus 16 may be equally applicable to four-piece golf balls (not shown) or five- or more-piece golf balls (not shown).

Further, once the golf ball 14 is completely coated, each layer, e.g., the core center 96, the one or more core layers 98, and the cover 94, may be substantially concentric with every other layer such that every layer shares a common geometric center. Additionally, a mass distribution of each layer may be uniform such that a center of mass for each layer and the golf ball 14 as a whole may be coincident with the geometric center.

The core 92 may be formed from any suitable material. For example, the core 92 may be formed from an ionomer, a polymer, a cured product of a rubber composition, and a combination of these materials. In addition, for embodiments including the core center 96 and the one or more core layers 98, the core center 96 and the one or more core layers 98 may also be formed from an ionomer, a polymer, a cured product of a rubber composition, and a combination of these materials.

In addition, the external surface 18 of the golf ball 14 may define an outermost portion of the golf ball 14, and may define any desired number and configuration of dimples (shown generally at 100 in FIG. 3). For example, the golf ball 14 may define from 280 dimples 100 to 432 dimples 100, or from 300 dimples 100 to 392 dimples 100, or from 298 dimples 100 to 360 dimples 100. Generally, the dimples 100 may decrease an aerodynamic drag of the golf ball 14 during flight and may provide the golf ball 14 with increased flight distance when the golf ball 14 is properly struck during play. Further, the dimples 100 may have any suitable shape including, for example, a circle or polygon. Also, spacing between adjacent dimples 100 may be selected according to desired aerodynamic characteristics of the golf ball 14.

Referring again to FIG. 2, the apparatus 16 for forming the golf ball 14 includes a conveyor 102 translatable along a longitudinal axis 30 that is substantially parallel to the ground plane 200. The conveyor 102 may be configured for transporting the partially-coated golf ball 28 and/or the golf ball 14 from one method operation, e.g., spraying 24, to a subsequent method operation, e.g., rotating 72. The conveyor 102 may include a belt (not shown) continuously translatable along the longitudinal axis 30. Alternatively, the conveyor 102 may include a plurality of tread elements (not shown) configured for interlocking with one another to form a track or band. Therefore, although not shown, the conveyor 102 may form a continuous loop, e.g., about a plurality of driven wheels, so that the method 10, 110 may be performed as a continuous, automated manufacturing operation.

The apparatus 16 may further include the tripod 66 extending from the conveyor 102. The tripod 66 may be configured for supporting the partially-coated golf ball 28 and/or the golf ball 14, and may be removably attached to the conveyor 102. For example, the tripod 66 may interlock with or snap onto the conveyor 102 so that the tripod 66 may be removed from the conveyor 102 for cleaning and/or maintenance operations. Further, when attached to the conveyor 102, the platform 68 of the tripod 66 may be disposed parallel to the conveyor 102.

The apparatus 16 also includes a rotation device 104 spaced apart from the conveyor 102 and translatable along a vertical axis 106 that is perpendicular to the longitudinal axis 30. That is, the rotation device 104 may be alternatingly translatable towards and away from the tripod 66 along the vertical axis 106, e.g., in the direction of arrows 208 and 108. In particular, after the first quantity 26 of the coating composition is sprayed onto the golf ball 14, the rotation device 104 may lift the partially-coated golf ball 28 away from the platform 68, i.e., in the direction of arrow 108, rotate the partially-coated golf ball 28, and subsequently translate the partially-coated golf ball 28 towards the platform 68 in the direction of arrow 208 in preparation for spraying 82 the second quantity 84 of the coating composition onto the partially-coated golf ball 28. Further, the rotation device 104 may rotate and/or revolve the partially-coated golf ball 28 about the axis of rotation 44 that is parallel to the longitudinal axis 30.

As illustrated in FIGS. 4A-5C, the rotation device 104 includes the first plate 78, the second plate 178 spaced apart from the first plate 78, and at least one needle 74, 174, 274, 374 extending from each of the first plate 78 and the second plate 178. The at least one needle 74, 174, 274, 374 may be attached to and extend from each of the first plate 78 and the second plate 178 in any manner. For example, the at least one needle 74, 174, 274, 374 may be welded, snapped, or bolted onto the first plate 78 and/or the second plate 178.

In one embodiment, as shown in FIGS. 4A-4C, the rotation device 104 includes the first pair 76 of two needles 74, 174 extending from the first plate 78 and the second pair 176 of two needles 274, 374 extending from the second plate 178. As such, the first plate 78 and the second plate 178 may be rotatable with respect to the conveyor 102.

In another embodiment, as shown in FIGS. 5A-5C, the rotation device 104 includes the first needle 74 extending from the first plate 78 and the second needle 274 extending from the second plate 178. That is, the first plate 78 and the second plate 178 may not be rotatable with respect to the conveyor 102.

The method 10, 110 and apparatus 16 (FIG. 2) form the coating layer 12 on the external surface 18 (FIG. 6) of the golf ball 14, and the coating layer 12 has a substantially even thickness 20 (FIG. 6) at every location on the golf ball 14. That is, the coating layer 12 evenly coats or covers a substantial entirety of the golf ball 14. As such, the coating layer 12 is generally free from unevenly-coated or non-coated portions.

Further, the method 10, 110 and apparatus 16 minimize deformation or sag of the coating layer 12 during manufacturing operations, such as curing 86 (FIG. 1) or drying of the coating layer 12 or during deposition of additional coating layers 12. In particular, for embodiments including revolving 90 (FIG. 1), such revolving 90 may minimize or prevent a build-up of the coating layer 12 on a lower portion of one or more dimples 100 (FIG. 3) of the golf ball 14 due to gravity.

As such, the method 10, 110 and apparatus 16 are economical and produce golf balls 14 having excellent physical properties. In particular, the cured coating layer 112 (FIG. 6) formed from the coating layer 12 has excellent adhesion to the external surface 18 of the golf ball 14. As such, the cured coating layer 112 may not peel, delaminate, or chip when the golf ball 14 is exposed to sunlight or used during prolonged play. Therefore, the golf ball 14 has excellent gloss, color, durability, and spin during flight.

While the best modes for carrying out the disclosure have been described in detail, those familiar with the art to which this disclosure relates will recognize various alternative designs and embodiments for practicing the disclosure within the scope of the appended claims.

The invention claimed is:

1. A method of forming a coating layer on a golf ball, the method comprising:

spraying a first quantity of a coating composition onto the golf ball to form a partially-coated golf ball having:

a first pole disposed in a top position, wherein the top position is spaced apart from a ground plane by a first distance;

a second pole disposed in a bottom position, wherein the bottom position is spaced apart from the ground plane by a second distance that is less than the first distance;

a diameter extending between the first pole and the second pole;

an axis of rotation perpendicular to the diameter, wherein the axis of rotation intersects the diameter at a midpoint between the first pole and the second pole;

a partially-coated surface; and a first equator defined by a first plane that is perpendicular to the diameter and intersects the partially-coated surface, wherein the first equator circumnavigates the partially-coated surface and is equidistant from the first pole and the second pole;

after spraying the first quantity, rotating the partially-coated golf ball about the axis of rotation to translate the first pole and the second pole such that the first pole is disposed in the bottom position and the second pole is disposed in the top position;

wherein rotating includes disposing the partially-coated golf ball between at least two needles such that the at least two needles abut the partially-coated golf ball on the first equator; and after rotating, spraying a second quantity of the coating composition onto the partially-coated golf ball to form the coating layer on the golf ball.

2. The method of claim 1, wherein rotating includes disposing the partially-coated golf ball between four needles.

3. The method of claim 2, wherein rotating includes disposing a first pair of two needles on the first equator and disposing a second pair of two needles substantially opposite the first pair on the first equator.

4. The method of claim 3, wherein the first pair of two needles is attached to a first plate and the second pair of two needles is attached to a second plate spaced apart from the first plate, and further wherein rotating includes concurrently turning each of the first plate and the second plate approximately 180° about the axis of rotation.

5. The method of claim 3, wherein rotating includes clamping the partially-coated golf ball between four needles so that the partially-coated golf ball does not spin with respect to the four needles as the first pole translates from the top position to the bottom position.

6. A method of forming a coating layer on a golf ball, the method comprising:

spraying a first quantity of a coating composition onto the golf ball to form a partially-coated golf ball having:

a first pole disposed in a top position, wherein the top position is spaced apart from a ground plane by a first distance;

a second pole disposed in a bottom position, wherein the bottom position is spaced apart from the ground plane by a second distance that is less than the first distance;

a diameter extending between the first pole and the second pole;

an axis of rotation perpendicular to the diameter, wherein the axis of rotation intersects the diameter at a midpoint between the first pole and the second pole;

a partially-coated surface; and a first equator defined by a first plane that is perpendicular to the diameter and intersects the partially-coated surface, wherein the first equator circumnavigates the partially-coated surface and is equidistant from the first pole and the second pole;

after spraying the first quantity, rotating the partially-coated golf ball about the axis of rotation to translate the first pole and the second pole such that the first pole is disposed in the bottom position and the second pole is disposed in the top position;

wherein rotating includes disposing the partially-coated golf ball between two needles such that the two needles abut the partially-coated golf ball between the first equator and the second pole and are disposed substantially opposite one another; and after rotating, spraying a second quantity of the coating composition onto the partially-coated golf ball to form the coating layer on the golf ball.

7. The method of claim 6, wherein the partially-coated golf ball further has:

a first hemisphere, wherein the first pole is disposed within the first hemisphere;

a second hemisphere spaced apart from the first hemisphere by the first equator, wherein the second pole is disposed within the second hemisphere;

a second equator defined by a second plane that is perpendicular to the axis of rotation and intersects the partially-coated surface, wherein the second equator circumnavigates the partially-coated surface through the first pole and the second pole and intersects the first equator;

a third hemisphere; and a fourth hemisphere spaced apart from the third hemisphere by the second equator; and further wherein rotating includes disposing a first needle within the second hemisphere and the third hemisphere and disposing a second needle substantially opposite the first needle within the second hemisphere and the fourth hemisphere.

8. The method of claim 6, wherein rotating includes clamping the partially-coated golf ball between the two needles so that the partially-coated golf ball spins with respect to the two needles as the first pole translates from the top position to the bottom position.

9. The method of claim 6, wherein a first needle is attached to a first plate and a second needle is attached to a second plate spaced apart from the first plate, and further wherein rotating includes moving the partially-coated golf ball such that the first pole translates from the top position to the bottom position and each of the first plate and the second plate does not rotate about the axis of rotation.

10. The method of claim 1, wherein rotating includes translating the first pole and the second pole approximately 180° about the axis of rotation.

11. A method of forming a coating layer on a golf ball, the method comprising:

spraying a first quantity of a coating composition onto the golf ball to form a partially-coated golf ball having:

a first pole disposed in a top position, wherein the top position is spaced apart from a ground plane by a first distance;

a second pole disposed in a bottom position, wherein the bottom position is spaced apart from the ground plane by a second distance that is less than the first distance;

a diameter extending between the first pole and the second pole;

an axis of rotation perpendicular to the diameter, wherein the axis of rotation intersects the diameter at a midpoint between the first pole and the second pole;

a partially-coated surface; and a first equator defined by a first plane that is perpendicular to the diameter and intersects the partially-coated surface, wherein the first equator circumnavigates the partially-coated surface and is equidistant from the first pole and the second pole; and after spraying the first quantity, rotating the partially-coated golf ball about the axis of rotation to translate the first pole and the second pole such that the first pole is disposed in the bottom position and the second pole is disposed in the top position;

after rotating, spraying a second quantity of the coating composition onto the partially-coated golf ball; and after spraying the second quantity, revolving the partially-coated golf ball about the axis of rotation to translate the first pole and the second pole such that the first pole is again disposed in the top position and the second pole is again disposed in the bottom position to form the coating layer on the golf ball;

wherein revolving includes disposing a first pair of two needles on the first equator and disposing a second pair of two needles substantially opposite the first pair on the first equator.

12. The method of claim 11, wherein revolving includes substantially evenly distributing the coating composition on the golf ball.

13. The method of claim 11, wherein revolving includes clamping the partially-coated golf ball between four needles so that the partially-coated golf ball does not spin with respect to the four needles as the first pole translates from the bottom position to the top position.

* * * * *